US011519412B2

(12) United States Patent
Broucke et al.

(10) Patent No.: US 11,519,412 B2
(45) **Date of Patent: *Dec. 6, 2022**

(54) OIL-INJECTED MULTISTAGE COMPRESSOR DEVICE AND METHOD FOR CONTROLLING A COMPRESSOR DEVICE

(71) Applicant: ATLAS COPCO AIRPOWER, NAAMLOZE VENNOOTSCHAP, Wilrijk (BE)

(72) Inventors: Stijn Broucke, Wilrijk (BE); Pieter De Schamphelaire, Wilrijk (BE)

(73) Assignee: ATLAS COPCO AIRPOWER. NAAMLOZE VENNOOTSCHAP, Wilrijk (BE)

( * ) Notice: Subject to any disclaimer, the term of this patent is extended or adjusted under 35 U.S.C. 154(b) by 0 days.

This patent is subject to a terminal disclaimer.

(21) Appl. No.: 17/272,521

(22) PCT Filed: Sep. 24, 2019

(86) PCT No.: PCT/IB2019/058064

§ 371 (c)(1),
(2) Date: Mar. 1, 2021

(87) PCT Pub. No.: WO2020/065506

PCT Pub. Date: Apr. 2, 2020

(65) Prior Publication Data

US 2021/0324858 A1 Oct. 21, 2021

(30) Foreign Application Priority Data

Sep. 25, 2018 (BE) ..... 2018/5657
Sep. 25, 2018 (BE) ..... 2018/5658
Apr. 1, 2019 (BE) ..... 2019/5205

(51) Int. Cl.
*F01C 21/04* (2006.01)
*F03C 2/00* (2006.01)
(Continued)

(52) U.S. Cl.
CPC ..... *F04C 29/021* (2013.01); *F04C 18/16* (2013.01); *F04C 23/001* (2013.01); *F04C 28/02* (2013.01);
(Continued)

(58) Field of Classification Search
CPC ..... F04C 18/16; F04C 23/001; F04C 28/02; F04C 28/24; F04C 29/0007;
(Continued)

(56) References Cited

U.S. PATENT DOCUMENTS 3,759,052 A 9/1973 Inoue
4,289,461 A * 9/1981 van Oorschot ..... F04C 29/0014 418/84
(Continued)

FOREIGN PATENT DOCUMENTS

EP 1 746 289 A1 1/2007
JP 05-044678 A 2/1993
(Continued)

OTHER PUBLICATIONS

Written Opinion for PCT/IB2019/058064, dated Dec. 16, 2019.
International Search Report for PCT/IB2019/058064, dated Dec. 16, 2019.

*Primary Examiner* — Theresa Trieu
(74) *Attorney, Agent, or Firm* — Sughrue Mion, PLLC

(57) ABSTRACT

Oil-injected multistage compressor device including a low-pressure compressor element (2) with a gas inlet (4*a*) for gas to be compressed and a gas outlet (5*a*) for low-pressure compressed gas and a high-pressure stage compressor element (3) with a gas inlet (4*b*) for low-pressure compressed
(Continued)

gas and a gas outlet (5*b*) for high-pressure compressed gas. The gas outlet (5*a*) of element (2) is connected to inlet (4*b*) of element (3) via a conduit (6). The conduit (6) has a regulatable intercooler (9) configured to regulate the temperature at the gas inlet (4*b*) of the high-pressure stage compressor element (3) so that it is above the dew point. The intercooler (9) includes a regulatable air cooler and/or a regulatable water cooler, and is configured to adjust the temperature of the air or water by using a bypass conduit (16) and/or by screening off part of the intercooler (9).

16 Claims, 2 Drawing Sheets

(51) Int. Cl.

| | |
|---|---|
| ***F03C 4/00*** | (2006.01) |
| ***F04C 15/00*** | (2006.01) |
| ***F04C 29/02*** | (2006.01) |
| ***F04C 18/16*** | (2006.01) |
| ***F04C 23/00*** | (2006.01) |
| ***F04C 28/02*** | (2006.01) |
| ***F04C 28/24*** | (2006.01) |
| ***F04C 29/04*** | (2006.01) |

(52) U.S. Cl.
CPC ..... *F04C 28/24* (2013.01); *F04C 29/04* (2013.01); *F04C 2270/195* (2013.01); *F04C 2270/205* (2013.01)

(58) Field of Classification Search
CPC .... F04C 29/0014; F04C 29/021; F04C 29/04; F04C 2240/40; F04C 2240/402; F04C 2270/195; F04C 2270/205; F04B 25/00; F04B 25/005; F04B 35/04; F04B 35/06
See application file for complete search history.

(56) References Cited

U.S. PATENT DOCUMENTS

| | | | | |
|---|---|---|---|---|
| 5,174,741 | A * | 12/1992 | Tohgo | F04C 29/0014 418/84 |
| 5,236,311 | A | 8/1993 | Lindstrom | |
| 5,318,151 | A * | 6/1994 | Hood | F04C 29/021 418/84 |
| 6,506,027 | B1 * | 1/2003 | Timuska | F04B 37/14 417/251 |
| 2004/0217180 | A1 | 11/2004 | Lu | |
| 2010/0089078 | A1 * | 4/2010 | Kishi | F04C 23/001 418/9 |
| 2010/0135840 | A1 * | 6/2010 | Fujimoto | F04C 18/16 418/201.1 |
| 2011/0023533 | A1 | 2/2011 | Shimazu | |
| 2011/0036110 | A1 | 2/2011 | Fujimoto et al. | |
| 2012/0023978 | A1 | 2/2012 | Chae et al. | |
| 2012/0291434 | A1 * | 11/2012 | Janssens | F04B 39/06 417/372 |
| 2017/0268498 | A1 | 9/2017 | Kasahara | |
| 2018/0245788 | A1 * | 8/2018 | Ohman | F22B 1/1838 |

FOREIGN PATENT DOCUMENTS

| | | | |
|---|---|---|---|
| WO | 02/25115 | A1 | 3/2002 |
| WO | 2011/017783 | A2 | 2/2011 |

* cited by examiner

OIL-INJECTED MULTISTAGE COMPRESSOR DEVICE AND METHOD FOR CONTROLLING A COMPRESSOR DEVICE

CROSS REFERENCE TO RELATED APPLICATIONS

This application is a National Stage of International Application No. PCT/IB2019/058064 filed Sep. 24, 2019, claiming priority based on Belgian Patent Application No. 2018/5657 filed Sep. 25, 2018, Belgian Patent Application No. 2018/5658 filed Sep. 25, 2018 and Belgian Patent Application No. 2019/5205 filed Apr. 1, 2019.

BACKGROUND OF THE INVENTION

Field of the Invention

The present invention relates to an oil-injected multistage compressor device.

Background

It is well known that with oil-free compression of gas using a compressor device, the technical limitations, especially as regards the maximum permitted outlet temperature of the compressed gas leaving the compressor element of said compressor device, dictate that the compression of the gas traditionally occurs in two or more steps or 'stages', whereby two or more compressor elements are placed in a series one after the other.

These technical limitations can be resolved by injecting a coolant such as water or oil into the compressor element, which makes single-stage compression possible.

Since having multiple stages involves substantial complexity and additional costs, the current preference is for an oil or water-injected single-stage compressor device.

Also, the fact that the maintenance of multistage compressor devices is more extensive and that they are more complex means that single-stage compressor devices are still often preferred.

The advantage of improved efficiency for the second and subsequent stages in a multistage compressor device would outweigh the aforementioned drawbacks. This improved efficiency would be possible by cooling the gas and thereby reducing the consumption of the second and subsequent stages. However, this is not as simple as it may seem.

There are already two-stage compressor devices in which oil is injected between the two stages in order to cool the compressed gas downstream from the first compression stage and upstream of the second compression stage, e.g. by using an oil curtain, whereby the cooler oil lowers the temperature of the gas.

However, such a solution only allows a limited cooling of the gas and provides only a limited improvement in efficiency over oil-free multistage compressor devices.

In addition, extra oil is added to the gas, which is not always desirable.

An oil-injected multistage compressor device can be used as an alternative, in which, for example, an intercooler is provided between the first and second compressor elements, whereby the intercooler will actively extract heat from the compressed gas after the first compression stage.

However, this is not done for the following reasons:

Firstly, pressure drop in this intercooler would be likely, meaning a loss of efficiency.

Secondly, the intercooling can cause the formation of condensate. The presence of condensate in a subsequent, downstream compressor element must be avoided at all times. That is why cooling cannot be overdone, so that condensate can be avoided in all operating conditions. If condensate should occur, it will end up in the oil and then in the bearings and other parts where this oil is used.

Finally, such a solution is more complex and possibly more expensive compared to oil-free multistage compressor devices.

Due to the disadvantages that would be associated with using an intercooler in an oil-injected multistage compressor device, it should be possible, in principle, to achieve a significant gain in efficiency by cooling to ensure that the net result is favorable, whereby this gain can be limited by the presence of condensate.

Even if the problem of the condensate were not to come into play, it can be assumed that the cooling would still be insufficient because the temperature rise of the oil and gas mixture after the first compression stage would not be sufficient.

SUMMARY OF THE INVENTION

The present invention aims at providing a solution to at least one of the aforementioned and/or other disadvantages.

The object of the present invention is an oil-injected multistage compressor device that comprises at least one low-pressure stage compressor element with a gas inlet for gas to be compressed and a gas outlet for low-pressure compressed gas, and a high-pressure stage compressor element with a gas inlet for low-pressure compressed gas and a gas outlet for high-pressure compressed gas, whereby the outlet of the low-pressure stage compressor element is connected to the gas inlet of the high-pressure stage compressor element by a conduit, with the characteristics that a regulatable intercooler provided between the low-pressure stage compressor element and the high-pressure stage compressor element in the aforementioned conduit, which is configured in such a way that the temperature at the gas inlet of the high-pressure stage compressor element can be regulated so that it is above the dew point, that the intercooler comprises a regulatable air cooler and/or a regulatable water cooler, and that the intercooler is configured in such a way that the temperature of the air or the water can be changed by using a bypass conduit and/or by screening off part of the intercooler.

It has been found that cooling downstream from the low-pressure stage can cause a much bigger temperature drop in the gas than described in the literature.

When the temperature at the outlet of the low-pressure compressor element is measured, the temperature of the oil and gas mixture is measured. Due to the wet bulb effect, the temperature measured will be lower than the actual temperature of the gas.

In other words, the potential temperature drop of the gas that can be achieved is actually much greater than described in the literature.

This also means that the potential gain in efficiency by cooling is greater than previously assumed, so that the aforementioned disadvantages do not outweigh the improved efficiency.

One advantage is that, with the help of such an oil-injected multistage compressor device, greater performance can be achieved than with the known compressor devices without cooling or with an oil-injection in the form of an oil curtain.

According to the invention, the intercooler is also regulatable; the intercooler can be configured so that the temperature at the gas inlet of the high-pressure stage compressor element can be kept above the dew point.

Keeping the temperature at the inlet of the high-pressure stage compressor element above the dew point prevents condensate from forming at this location.

Making the intercooler regulatable means that maximum cooling is possible at any moment without forming condensate. It is therefore no longer necessary to assume a worst-case scenario when determining the cooling capacity of the intercooler. This is because, at the moment that the dew point would rise and the intercooler would cool the gas too much such that condensate would occur, the intercooler can be regulated to cool the gas less so that condensate does not form.

The intercooler can be made regulatable in various ways. A requirement of the regulatable intercooler is that the degree of cooling of the gas, or the temperature drop of the gas, can be changed. This can be done, for example, by changing the cooling capacity of the intercooler and/or by guiding part of the gas via a bypass conduit instead of via the intercooler.

As is already known, the dew point is not a fixed value but depends on various parameters such as temperature, humidity, and the pressure of the gas. There are various ways to determine this dew point.

The possible presence of condensate can be detected based on the dew point.

According to a preferred embodiment of the invention, the intercooler is provided with a heat pump.

This has the advantage that it is possible to cool to a much lower temperature, so that the maximum cooling capacity can be achieved when there is no risk of condensate forming downstream of the intercooler, so that the high-pressure stage compressor element will be much more efficient.

The total gain in efficiency or performance will therefore be a lot greater.

The invention also relates to a method for controlling an oil-injected multistage compressor device with a regulatable intercooler, characterized in that the method comprises the following steps:

calculating or determining the dew point at a gas inlet of a high-pressure stage compressor element of the compressor device;

regulating the intercooler that is provided downstream of the low-pressure stage and upstream of the high-pressure stage, so that the temperature at the gas inlet of the high-pressure stage compressor element is above the dew point.

The advantages of such a method are similar to the aforementioned advantages of the oil-injected multistage compressor device.

BRIEF DESCRIPTION OF THE DRAWINGS

To better demonstrate the features of the invention, the following describes, as a non-exhaustive example, some preferred embodiments of an oil-injected multistage compressor device and method according to the invention, with reference to the accompanying drawings, in which.

DETAILED DESCRIPTION OF THE INVENTION

Figure 1:
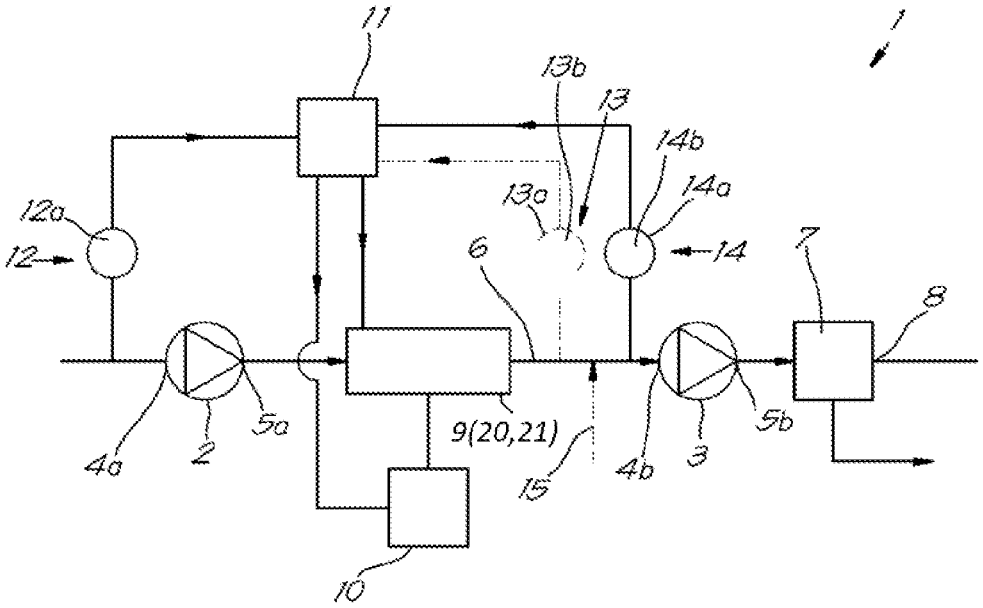
FIG. 1 shows the schematic for an oil-injected multistage compressor device according to the invention.

The schematically shown oil-injected multistage compressor device 1 in FIG. 1 comprises two steps or 'stages' in this case: a low-pressure stage with a low-pressure stage compressor element 2 and a high-pressure stage with a high-pressure stage compressor element 3.

Both compressor elements 2 and 3 in this example are screw compressor elements, but this is not necessary for the invention since other types of compressors can also be used.

Both compressor elements 2 and 3 are also provided with an oil circuit for the injection of oil in the respective compression chambers of the compressor elements 2 and 3. For clarity, these oil circuits are not shown in the Figure.

The low-pressure stage compressor element 2 has a gas inlet 4*a* for gas to be compressed and an outlet 5*a* for low-pressure compressed gas.

Gas outlet 5*a* is connected to gas inlet 4*b* of the high-pressure stage compressor element 3 via conduit 6.

The high-pressure stage compressor element 3 is also equipped with a gas outlet 5*b* for high-pressure compressed gas, whereby the outlet 5*b* is connected to a liquid separator 7.

It is possible for the outlet 8 of this liquid separator 7 to be connected to an aftercooler.

An intercooler 9 is included in the aforementioned conduit 6 between the low-pressure stage compressor element 2 and the high-pressure stage compressor element 3 which, according to the invention, can be regulated.

This intercooler 9 can be designed in various ways.

Intercooler 9 can, for example, include air cooling that can be controlled by a fan 20, for instance, whereby the air flow can be regulated by adjusting the speed of the fan 20.

Alternatively, intercooler 9 can include, for example, a water cooler that can be regulated by a valve 21, for instance, which may control the flow of the water.

It is also possible, for example, to regulate intercooler 9 by changing the temperature of the air or water.

In this case, intercooler 9 is equipped with a heat pump 10, although this is not necessary for the invention.

This heat pump 10 may also be regulatable, but this is not necessarily the case.

With the help of heat pump 10, it will be possible to extract even more heat from the gas.

Compressor device 1 is also equipped with a control unit or regulator 11 for controlling or regulating intercooler 9. If heat pump 10 is regulatable, this control unit or regulator 11 can also control heat pump 10.

In the example in FIG. 1, first measuring means 12 are also provided in the form of a sensor 12*a*. This sensor 12*a* is connected to the aforementioned control unit or regulator 11.

This regards, for example, a sensor 12*a* that can measure one or more environmental parameters at the gas inlet 4*a* of the low-pressure stage compressor element 2.

This sensor 12*a* can measure the pressure, temperature, and/or humidity.

It is not excluded that, instead of this sensor 12*a* or in addition to it, second measuring means 13 are provided, which measure the humidity at gas inlet 4*b* of high-pressure stage compressor element 3.

These second measuring means 13 could be a sensor 13*a*, provided at gas inlet 4*b* of high-pressure stage compressor element 3. The schematic for this is shown with a dotted line in the Figure.

Furthermore, device 1 as shown in the example is equipped with third measuring means 14 in the form of a sensor 14*a* at gas inlet 4*b* of high-pressure stage compressor element 3 in order to measure the temperature at this location.

Finally, it is not excluded for device 1 to be equipped with an oil-injection 15 so that oil can be injected into conduit 6 downstream from intercooler 9. The schematic for this is shown with a dotted line.

The operation of the oil-injected multistage compressor device 1 is very simple and as follows.

During operation, the gas to be compressed, e.g. air, will be sucked in via gas inlet 4*a* of low-pressure stage compressor element 2 and will undergo an first compression stage.

The partially compressed gas will flow via conduit 6 to intercooler 9, where it will be cooled and then to gas inlet 4*b* of high-pressure stage compressor element 3 for subsequent compression.

Oil will be injected into both low-pressure stage compressor element 2 and in high-pressure stage compressor element 3, which ensures the lubrication and cooling of compressor elements 2, 3.

The compressed gas will leave high-pressure stage compressor element 3 via gas outlet 5*b* and then be guided to oil separator 7.

The injected oil will be separated and the compressed gas can then possibly be guided to an aftercooler before being sent to consumers.

In order to ensure that condensate is not formed when the gas is cooled by intercooler 9, this intercooler 9 must be properly regulated to accommodate changes in the environmental parameters and/or drive parameters of compressor elements 2, 3.

For this, the control unit or regulator 11 will regulate intercooler 9 so that the temperature of inlet 4*b* of high-pressure stage compressor element 3 is above the dew point. As previously mentioned, this results in no condensate forming after intercooler 9 at gas inlet 4*b* of high-pressure stage compressor element 3.

In a first step, the dew point, or accordingly the presence of condensate, at gas inlet 4*b* of high-pressure stage compressor element 3 is determined or calculated. The dew point depends on various parameters and is therefore a variable and not a fixed value.

There are different options or ways to determine the dew point.

In the case of the embodiment shown in FIG. 1, the dew point is determined by measuring the environmental parameters using a sensor 12*a*.

For this, the measured values of sensor 12*a* are transmitted to the control unit or regulator 11, which calculates the dew point on this basis.

If the oil-injected multistage compressor device 1 is equipped with a humidity sensor 13*b* at gas inlet 4*b* of high-pressure stage compressor element 3, it is also possible to directly determine the dew point, or accordingly the presence of condensate, based on measuring the humidity at gas inlet 4*b*. Humidity sensor 13*b* will also transmit the measured value to control unit 11 at this point.

Another alternative is to determine the dew point by following the course of the temperature at gas inlet 4*b* of high-pressure stage compressor element 3, e.g. by using temperature sensor 14*b* at inlet 4*b* of high-pressure stage compressor element 3 or another sensor specially provided for this purpose.

In this case, temperature sensor 14*b* will transmit the measured values of the temperature at gas inlet 4*b* to the control unit or regulator 11, which monitors and evaluates the course of the measured temperatures to use as a basis for determining the dew point.

Once the dew point has been determined, the control unit or regulator 11 will regulate intercooler 9 as necessary so that the temperature at gas inlet 4*b* of high-pressure stage compressor element 3 is above the dew point.

For this purpose, the control unit or regulator 11 will request the temperature at gas inlet 4*b* using temperature sensor 14*b* and compare it with the determined dew point.

Control unit 11 will allow intercooler 9 to cool more when this temperature at inlet 4*b* is higher than the dew point, since the temperature of the gas can fall even more without the formation of condensate.

If the temperature is still higher than the dew point when intercooler 9 is already cooling at maximum output, control unit 11 will start heat pump 10.

Of course, it is also possible that heat pump 10 is continuously in operation and that the regulation is carried out only using intercooler 9.

It is also possible for heat pump 10 to be regulated, so that when the dew point falls and there is then an increase in the required cooling capacity, control unit 11 allows an increase in cooling capacity first in intercooler 9 and then heat pump 10 or vice versa or both simultaneously or alternately.

If the temperature at gas inlet 4*b* of high-pressure stage compressor element 3 is lower or equal to the dew point, control unit 11 will have intercooler 9 cool less, so that the temperature of the gas will rise to prevent the formation of condensate.

If heat pump 10 is also regulatable, control unit 11 can first lower the cooling capacity of heat pump 10 or alternatively lower the cooling capacity of intercooler 9 and of heat pump 10.

If the dew point drops, the control unit or regulator 11 can have intercooler 9 once again cool more, so that the temperature of the gas will fall again.

In this way, maximum cooling is always possible without the formation of condensate.

Always being able to cool optimally means that the performance of high-pressure stage compressor element 3 can be maximized.

If device 1 is equipped with oil-injection 15, this can be used to achieve additional cooling of the gas. In addition, the injected oil will provide additional lubrication for high-pressure stage compressor element 3.

Figure 2:
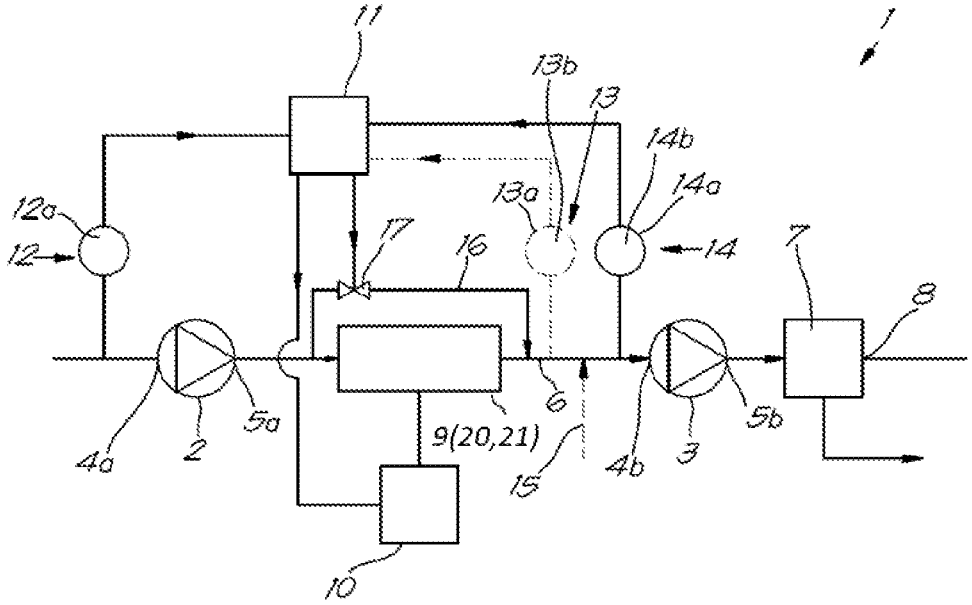
FIGS. 2 and 3 show the schematics for a variant of FIG. 1.

An alternative embodiment is shown in FIG. 2, in which in this case a bypass conduit 16 is provided over intercooler 9, which bypass conduit 16 is configured to divert part of the gas so that it can flow directly from low-pressure stage compressor element 2 to high-pressure stage compressor element 3 without passing through intercooler 9. For this purpose, bypass conduit 16 can be equipped with a valve 17 to regulate the amount of gas flowing through bypass conduit 16. In this case, valve 17 is connected to the control unit or regulator 11 for its control.

Figure 3:
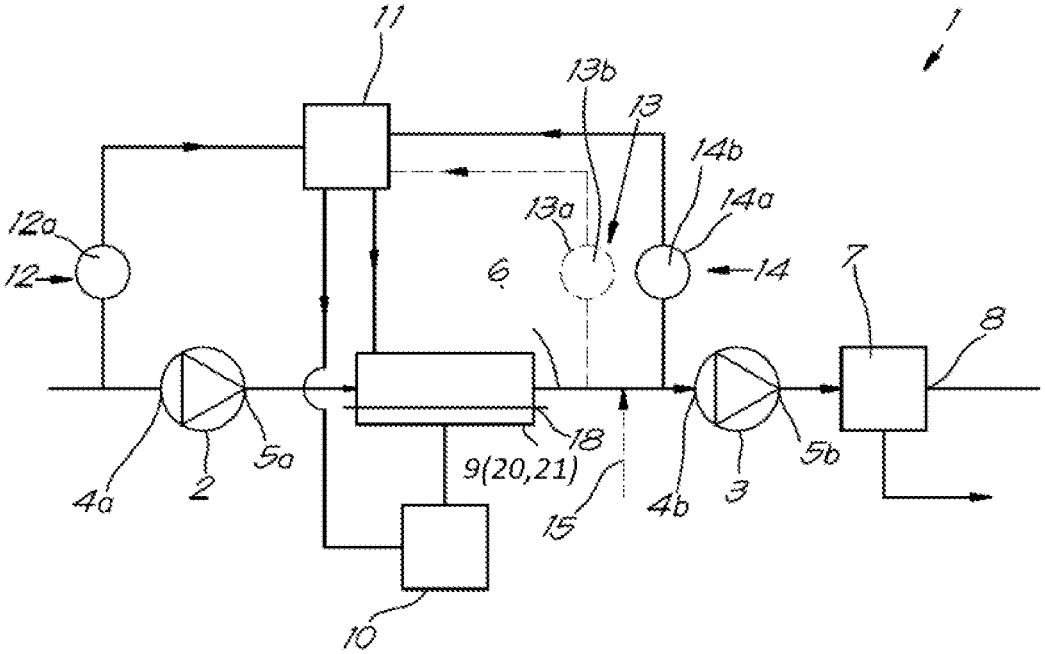

FIG. 3 shows yet another design embodiment of intercooler 9, whereby a part of intercooler 9 can be screened off, e.g. with a plate 18 or similar, so that not the entire intercooler 9 is used. In other words, the gas to be cooled is not exposed to the entire intercooler 9.

The present invention is by no means limited to the embodiments described as examples and shown in the figures, but an oil-injected multistage compressor device according to the invention and a method for controlling a compressor device can be achieved following different variants without going beyond the scope of the invention.

The invention claimed is:

1. An oil-injected multistage compressor device comprising:

a low-pressure stage compressor (2) with a gas inlet (4*a*) for gas to be compressed and a gas outlet (5*a*) for low-pressure compressed gas; and a high-pressure stage compressor (3) with a gas inlet (4*b*) for low-pressure compressed gas and a gas outlet (5*b*) for high-pressure compressed gas, wherein the gas outlet (5*a*) of the low-pressure stage compressor (2) is connected to the gas inlet (4*b*) of the high-pressure stage compressor (3) via a conduit (6), wherein the oil-injected multistage compressor device further comprises a regulatable intercooler (9) that is connected to the conduit (6) between the low-pressure stage compressor (2) and the high-pressure stage compressor (3) and is configured to regulate a temperature at the gas inlet (4*b*) of the high-pressure stage compressor (3) to be above a dew point, wherein:

the regulatable intercooler (9) comprises a regulatable air cooler or a regulatable water cooler, and the regulatable intercooler (9) is configured in such a way that temperature of air or water is changed by using a bypass conduit (16) or by screening off a part of the regulatable intercooler (9).

2. The oil-injected multistage compressor device according to claim 1, further comprising a controller (11) and at least one sensor, wherein the controller (11) is configured to determine the dew point based on an output of the at least one sensor.

3. The oil-injected multistage compressor device according to claim 1, further comprising a controller (11) and a sensor, wherein the controller (11) is configured to determine the dew point based on an output of the sensor, wherein the sensor is configured to measure humidity at the gas inlet (4*b*) of the high-pressure stage compressor (3).

4. The oil-injected multistage compressor device according to claim 1, further comprising a controller (11) and a sensor, wherein the controller (11) is configured to determine the dew point based on an output of the sensor, wherein the sensor is configured to measure the temperature at the gas inlet (4*b*) of the high-pressure stage compressor (3).

5. The oil-injected multistage compressor device according claim 1, wherein the regulatable intercooler (9) comprises the regulatable air cooler, the regulatable air cooler is regulatable by a fan, whereby airflow is regulated by adjusting a speed of the fan.

6. The oil-injected multistage compressor device according to claim 1, wherein the regulatable intercooler (9) comprises the regulatable water cooler, the regulatable water cooler is configured in such a way that it is regulatable by a valve for regulating flow of the water.

7. The oil-injected multistage compressor device according to claim 1, wherein the regulatable intercooler (9) is connected to a heat pump (10).

8. The oil-injected multistage compressor device according to claim 7, wherein the heat pump (10) is regulatable.

9. The oil-injected multistage compressor device according to claim 1, wherein an oil-injection (15) is provided in the conduit (6) downstream from the regulatable intercooler (9).

10. The oil-injected multistage compressor device according to claim 1, further comprising a controller (11) for regulating the regulatable intercooler (9).

11. A method for controlling an oil-injected multistage compressor device (1), comprising the following steps:

determining a dew point at a gas inlet (4*b*) of a high-pressure stage compressor (3) of the oil-injected multistage compressor device (1) based on an output of at least one sensor;

regulating an intercooler (9) that is provided upstream of the high-pressure stage compressor, so that a temperature at the gas inlet (4*b*) of the high-pressure stage compressor (3) is above the dew point, wherein the regulating the intercooler (9) comprises:

regulating an air cooler or a water cooler of the intercooler (9), and using a bypass conduit (16) that bypasses the intercooler (9), or screening off a part of the intercooler (9).

12. The method of claim 11, wherein the dew point is determined by measuring of one or more environmental parameters.

13. The method of claim 12, wherein the one or more environmental parameters include at least one from among pressure, temperature, and humidity.

14. The method of claim 11, wherein the dew point is determined by measuring humidity at the gas inlet (4*b*) of the high-pressure stage compressor (3).

15. The method of claim 11, wherein the dew point is calculated by monitoring a course of the temperature at the gas inlet (4*b*) of the high-pressure stage compressor (3).

16. The method according to claim 11, wherein the intercooler (9) is regulated by a controller (11) that regulates the intercooler (9) so that the temperature at the gas inlet (4*b*) of the high-pressure stage compressor (3) is above the dew point.

* * * * *